US005481971A

United States Patent [19]

Grützmacher et al.

[11] Patent Number: 5,481,971

[45] Date of Patent: Jan. 9, 1996

[54] DRIVE FOR A PRINTING PRESS WITH A PLURALITY OF PRINTING UNITS

[75] Inventors: Bertold Grützmacher, Schriesheim; Anton Rodi, Leimen; Bernhard Wagensommer, Wiesloch, all of Germany

[73] Assignee: Heidelberger Druckmaschinen AG, Heidelberg, Germany

[21] Appl. No.: 343,028

[22] Filed: Nov. 21, 1994

Related U.S. Application Data

[63] Continuation-in-part of Ser. No. 227,199, Apr. 13, 1994, abandoned, which is a continuation-in-part of Ser. No. 979,069, Nov. 19, 1992, abandoned.

[30] Foreign Application Priority Data

Nov. 19, 1991 [DE] Germany ..... 41 37 979.9

[51] Int. Cl.[6] ..... B41F 5/02

[52] U.S. Cl. ..... 101/183

[58] Field of Search ..... 101/181, 180, 101/183, 177, 136, 137, 138, 139, 140, 179, 229, 230, 231, 232, 233

[56] References Cited

U.S. PATENT DOCUMENTS 3,557,692 1/1971 Lee .
4,891,566 2/1990 Stürwald et al. .

FOREIGN PATENT DOCUMENTS 0243661 6/1992 European Pat. Off. .
3503178 9/1985 Germany .

*Primary Examiner*—J. Reed Fisher
*Attorney, Agent, or Firm*—Herbert L. Lerner; Laurence A. Greenberg

[57] ABSTRACT

A printing press includes a plurality of mutually mechanically decoupled printing-unit groups each having at least one individual printing unit. A drive for the printing press includes drive motors each being associated with a respective one of the printing-unit groups. Devices are each associated with a respective one of the printing-unit groups for rotational-speed and/or angle-of-rotation determination. An angle feedback control device dimensions a permissible angle-of-rotation deviation of the printing-unit groups from a preselected angle setpoint value in such a way that the deviation is minimal at least in an angle-of-rotation position in which sheet transfer takes place.

6 Claims, 7 Drawing Sheets

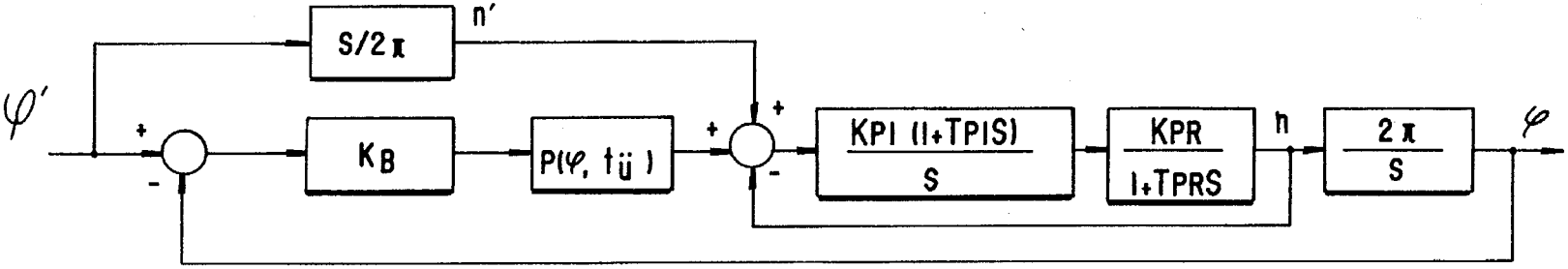
Fig.7
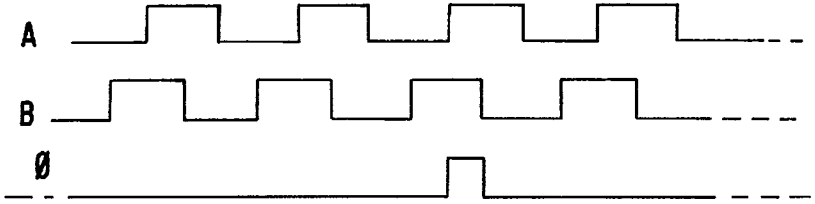
Fig.9A
Fig.9B
Fig.9C
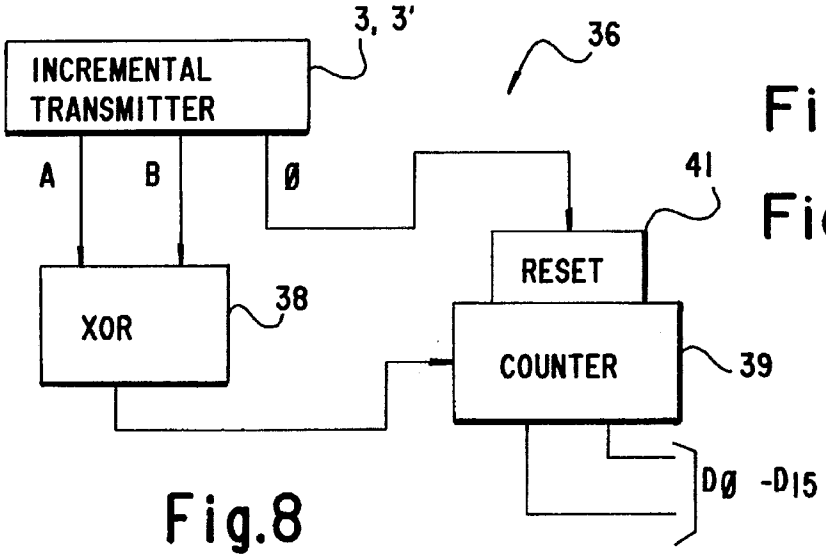
Fig.8

DRIVE FOR A PRINTING PRESS WITH A PLURALITY OF PRINTING UNITS

CROSS-REFERENCE TO RELATED APPLICATION

This application is a continuation-in-part of application Ser. No. 08/227,199, filed Apr. 13, 1994, now abandoned which was a file-wrapper continuation of Ser. No. 07/979,069, filed Nov. 19, 1992, now abandoned.

SPECIFICATION

The invention relates to a multiple drive for a printing press with a plurality of printing units, wherein individual printing units or printing-unit groups are mechanically decoupled from one another, each printing unit or printing-unit group is associated with a drive motor, and each printing unit or printing-unit group is associated with a device for rotational-speed and/or angle-of-rotation determination.

In the field of printing, there are demands for both rationalization and an improvement in quality. In order to produce high-quality multi-color prints that are printed on both sides and possibly also varnished in one passage through the printing press, it is necessary, particularly in sheet-fed offset printing, to place a multiplicity of printing units one behind the other. Such printing units must be highly coordinated with respect to their mode of operation.

In order to guarantee the latter, the impression cylinders of the individual printing units usually mesh with the transfer drum disposed between two printing units and form a closed gear train. Through the use of one or more motors, the power is fed into the gear train at one or more points.

It becomes apparent in practice that, given an identical press speed, the greater the number of mechanically interconnected printing units, the greater the tendency of a printing press to vibrate. Such vibrations result in mackling in the printed image, which has a negative effect on the quality of the printed product.

In order to obviate the disadvantages arising from the rigid connection of the printing units, a drive on a multicolor printing press has already become known in which the individual mechanically decoupled printing units or printing-unit groups are each driven by a separate drive motor. In this case, the synchronization of the printing units is no longer achieved by the rigid gear train, but instead by the electrical synchronization of the individual drive motors.

One possible way of accomplishing such synchronization is described in German Published, Non-Prosecuted Application DE 35 03 178 A1, corresponding to British Patent No. 2 157 022. In order to ensure compliance with the controlled-movement conditions and thus to ensure the safeguarding of the quality parameters and the reduction of consequential damage through operator errors or mishaps, the aforementioned publication describes a process for the digital regulation or feedback control of n parallel-connected drives. Each of the n drives is associated with a subsidiary setpoint generator which determines the time-dependent or state-dependent movement relationship of the drive and supplies the drive-specific setpoint values. The subsidiary setpoint generators are subordinate to a master setpoint generator, which processes all of the influencing variables. In the case of the dynamic monitoring of the drives, the difference between the largest and smallest deviations of the n drives is constantly formed and compared with a maximum permissible difference. If the difference exceeds the value specified by the master setpoint generator, then, while maintaining the mutual movement relationship, the speed level of all of the drives is lowered to the specified limit according to any desired functional relationship.

The aim of the process, at all times, is to minimize the angular difference between the individual drives. Both the control parameters and the control structure are thus independent of the phase angles of the printing units.

It is accordingly an object of the invention to provide a multiple drive for a printing press with a plurality of printing units, which overcomes the hereinafore-mentioned disadvantages of the heretofore-known devices of this general type and in which the sheet transfer between the individual printing units is synchronized.

With the foregoing and other objects in view there is provided, in accordance with the invention, in a printing press including a plurality of mutually mechanically decoupled printing-unit groups each having at least one individual printing unit, a drive for the printing press, comprising drive motors each being associated with a respective one of the printing-unit groups, devices each being associated with a respective one of the printing-unit groups for at least one of rotational-speed and angle-of-rotation determination, and an angle feedback control device being connected to the drive motors and to the determining devices for dimensioning a permissible angle-of-rotation deviation of the printing-unit groups from a preselected angle setpoint value and for ensuring that the deviation is minimal at least in an angle-of-rotation position in which sheet transfer takes place.

The drive according to the invention guarantees a very high repeat accuracy with regard to sheet transfer. This is of great importance in sheet-fed offset printing, since irregularities in sheet transfer result in mackling and thus in color displacements, which have an extremely negative effect on the quality of the printed products.

In accordance with another feature of the invention, the permissible angle-of-rotation deviation of the individual printing units or printing-unit groups from a preselected angle setpoint value exhibits a preselectable dependence on the angular position of the printing unit or printing-unit group.

In particular, in accordance with a further feature of the invention, the permissible angle-of-rotation deviation within a preselectable range about the angle-of-rotation position in which sheet transfer takes place, is smaller than at angle-of-rotation positions outside the range.

According to the invention, the drive is constructed in such a way that the cylinders of the individual printing units or printing-unit groups have a precisely defined angular position at sheet transfer in order to prevent the aforementioned mackling effects. However, also within specified limits outside this sheet-transfer range, a specified permissible angle-of-rotation deviation must not be exceeded, because otherwise there might be gripper collisions between the gripper bridges of the impression cylinders and those of the transfer cylinders. Outside this critical range about the defined angular position at sheet transfer, the requirements in terms of the permissible angle-of-rotation deviations of the individual printing units or printing-unit groups are less stringent.

According to an advantageous embodiment of the drive according to the invention, for the synchronization of the printing units or printing-unit groups, the same angle setpoint is specified for each drive motor. This variant has the advantage of compensating for any deviations from the angle setpoint at the point at which they occur.

According to an alternative embodiment, for the synchronization of the printing units or printing-unit groups, an angle setpoint is specified for a selected drive motor and the next drive motor receives the actual value of the preceding drive motor as its setpoint.

The drive according to the invention is not based on the notion of correcting angular differences at each angular position or at each point in time, but instead of monitoring them so that a correct sheet transfer is achieved. The aim is furthermore to prevent mechanical collisions between the gripper bridges. Intervention in the printing process, and thus the excitation of vibrations, is reduced by specifying a relatively large tolerance band outside the range about the angular position for sheet transfer. Intervention in the control structure is concentrated in the range about the angular position at which sheet transfer takes place.

In order to minimize any angular differences between the individual printing units or printing-unit groups, particularly in the range of sheet transfer, an advantageous embodiment of the drive according to the invention provides for a correction value $n_{diff}$ to be added to the rotational-speed setpoint value $n_{setpoint}$, with the correction value $n_{diff}$ being dimensioned in such a way that the detected angular difference between the printing units or printing-unit groups is just compensated by the time sheet transfer takes place. For this purpose, the angle regulation or feedback control computes the time to sheet transfer from the rotational-speed setpoint value and the angle setpoint value at which sheet transfer is to take place. On the basis of the angle-of-rotation difference between the angle setpoint value and the angular position of the respective printing unit or printing-unit group and on the basis of the remaining time to sheet transfer, the regulation or feedback control determines the rotational-speed difference which, when added to the rotational-speed setpoint value, precisely compensates for the existing angle-of-rotation difference, by the time of sheet transfer. This calculated rotational-speed setpoint value is inputted into the rotational-speed regulation or feedback control as the new setpoint value.

In accordance with an added feature of the invention, the angle feedback control device has means for preselecting an angle setpoint value and for determining the respective angle-of-rotation deviation of the printing-unit groups with respect to the preselected angle setpoint value.

In accordance with an additional feature of the invention, the printing units groups include a first printing unit group and following printing units groups, and the angle feedback control device has means for preselecting an angle setpoint value for the first printing unit group and for determining the angle-of-rotation deviation of each of the following printing units groups with respect to the angle-of-rotation position of the preceding printing unit group.

In accordance with yet another feature of the invention, the angle feedback control device has means for determining a time to sheet transfer from the rotational-speed setpoint value and the angle setpoint value, the angle feedback control device has means for continuing to compute a rotational-speed difference $n_{diff}$ by which the rotational speed $n_{setpoint}$ must be increased or reduced in order to minimize the angle-of-rotation deviation in the remaining time to sheet transfer, and the angle feedback control device has means for controlling a corresponding one of the drive motors according to a calculated new rotational-speed setpoint value $n_{new}=n_{setpoint}+n_{diff}$.

According to an advantageous further development of the invention, it is further provided that the angle-of-rotation deviations regularly occurring during each revolution are stored as a function of the respective angular position of the printing unit or printing-unit group and as a function of the rotational speed. In particular, therefore, periodically occurring fluctuations in torque and rotational speed, and the periodically occurring deviations in angle of rotation that are connected with them, are used in this case in order to compute and prepare in advance the necessary changes in rotational speed as a function of the angular position. For example, one of the causes of the periodic fluctuations in torque is the cyclical movement of the gripper bridges.

In accordance with a concomitant feature of the invention, there is provided a storage apparatus associated with the angle feedback control device for storing the calculated rotational-speed setpoint values as a function of the angle-of-rotation position of the printing unit groups and as a function of the respective rotational speed of the printing press.

Other features which are considered as characteristic for the invention are set forth in the appended claims.

Although the invention is illustrated and described herein as embodied in a drive for a printing press with a plurality of printing units, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

FIG. 7 is a block diagram of the control function for the control arrangement;

FIG. 8 is a block diagram showing the circuit arrangement of the incremental transmitters for generating the clock pulse trains;

FIG. 9 is a timing diagram showing the phase-shifted pulse trains A and B, and the zero pulse 0.

Figure 1:
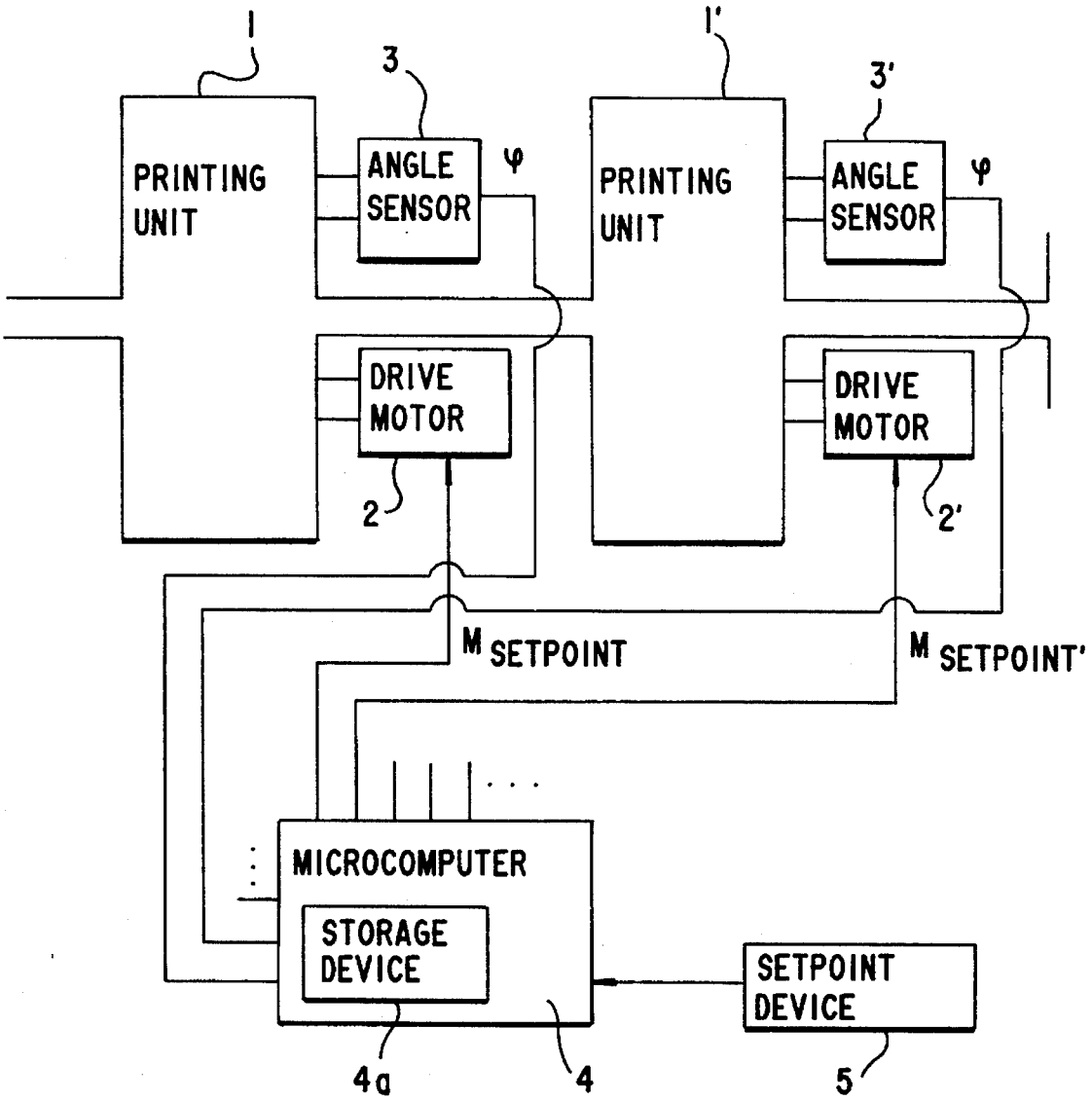
FIG. 1 is a diagrammatic and schematic view of a printing press with two printing units, wherein each printing unit is associated with its own drive motor.

Referring now to the figures of the drawing in detail and first, particularly, to FIG. 1 thereof, there is seen a diagrammatic and schematic representation of two printing units or printing-unit groups 1, 1' of a printing press which is not further illustrated. Each of the two printing units 1, 1' is associated with a respective drive or drive motor 2, 2'. Angle sensors 3, 3' which detect respective angular positions $\phi_{actual}$, $\phi'_{actual}$ of the printing units 1, 1', are disposed on single-revolution shafts of the respective printing units 1, 1'. The angular position $\phi_{actual}$, $\phi'_{actual}$ of the two printing units 1, 1' is supplied to a microcomputer 4. The microcomputer 4 is furthermore connected to a setpoint-input device 5 from which it receives a rotational-speed setpoint value $n_{setpoint}$ and an angle setpoint value $\phi_{setpoint}$ at which a sheet transfer is to take place. The microcomputer 4 computes torque setpoint values $M_{setpoint}$, $M'_{setpoint}$ on the basis of an angular difference $\phi_{diff}$ between the preselected angle setpoint value $\phi_{setpoint}$ and the angular positions $\phi_{actual}$, $\phi'_{actual}$ of the printing units 1, 1'. The torque values $M_{setpoint}$, $M'_{setpoint}$ are dimensioned in such a way that a permissible angle-of-rotation deviation of the individual printing units 1, 1' from the preselected setpoint value $\phi_{setpoint}$, i.e. the angular position at which sheet transfer takes place, is minimal.

FIGS. 2 to 5 show embodiment examples of the drive according to the invention.

Figure 2:
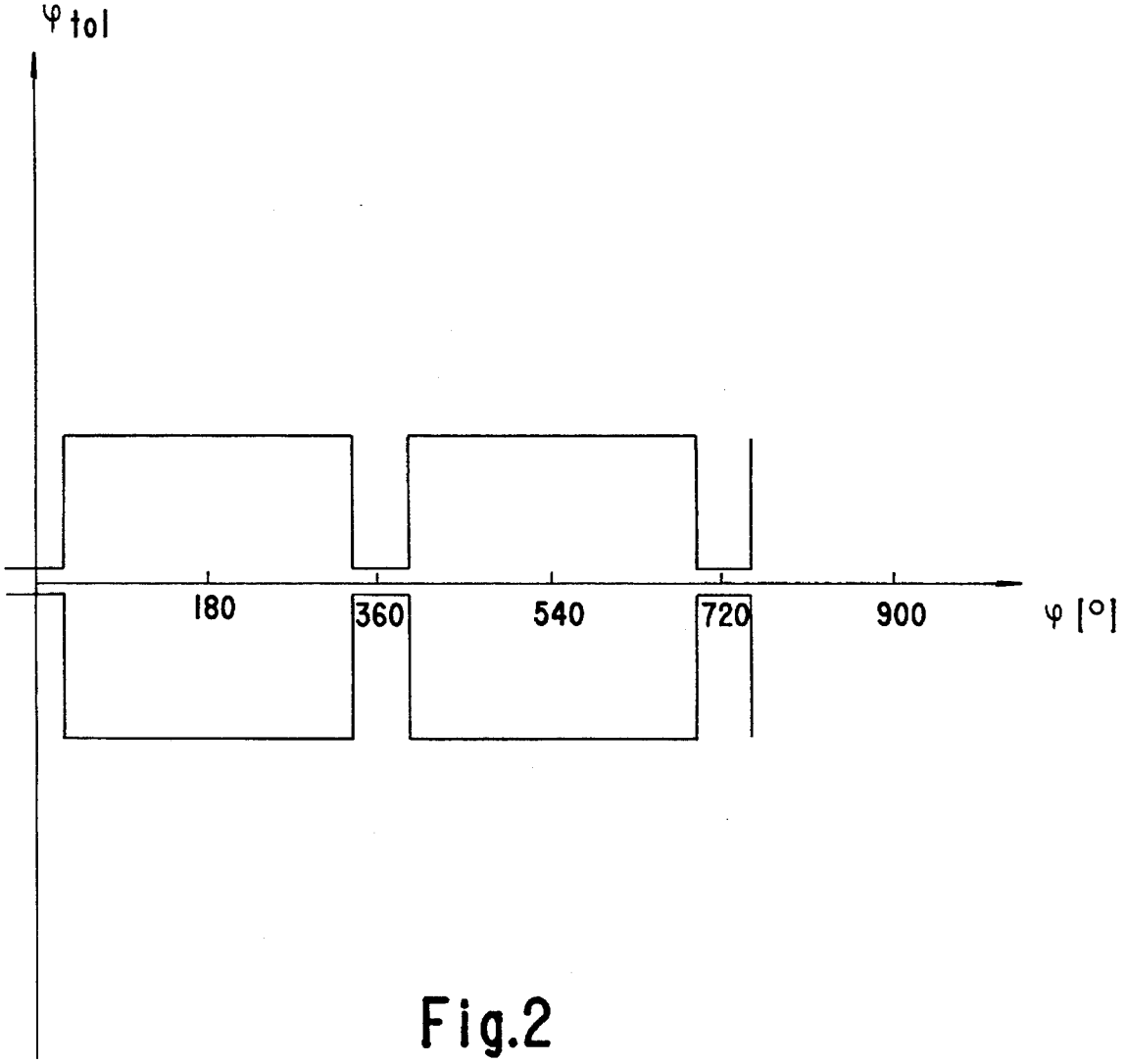
FIG. 2 is a graph representing dependence of a permissible rotational-speed deviation on an angular position of the printing unit in accordance with an embodiment of the drive according to the invention.

FIG. 2 shows respective tolerable angle-of-rotation and rotational-speed deviations $\phi_{tol}$ and $n_{tol}$ as a function of the respective angular position $\phi$ of the printing units 1, 1'. This graph shows the case in which sheet transfer takes place with the printing press in the zero position (0°, 360°, 720°, . . . ). Ideally, the drive according to the invention operates in such a manner that the setpoint angular position $\phi_{setpoint}$ of the printing units 1, 1' is reached precisely at the instant of sheet transfer. However, it is at least necessary for any angular deviation to be kept so small that mackling does not have an adverse effect on the quality of the printed product.

Outside of this angular-position range at which sheet transfer takes place, the requirements in terms of the tolerable angular deviations $\phi_{tol}$ between the individual printing units 1, 1' are less stringent. Nevertheless, it must be noted that, within a range about the angular position at which sheet transfer takes place, the permissible angle-of-rotation deviation is restricted by the gripper movement of the cylinders. If, in this case, a preselectable angle-of-rotation tolerance $\phi_{tol}$ is exceeded, there may be gripper collisions and thus damage to the gripper bridges and cylinders. Outside this range, in which the tolerable angular deviation $\phi_{tol}$ is restricted only by the specific structure of the cylinders, the permissible angle-of-rotation deviations $\phi_{tol}$ are greater.

Through the specification of an angle-of-rotation tolerance $\phi_{tol}$ that is dependent on the respective angular position of the printing units 1, 1', major control interventions in the drives 2, 2' of the printing units 1, 1' are concentrated around the range of the angular position $\phi_{setpoint}$ at sheet transfer. Outside a narrow range about the angular position at which sheet transfer takes place, interventions are required only to a minor extent, if at all.

Figure 3:
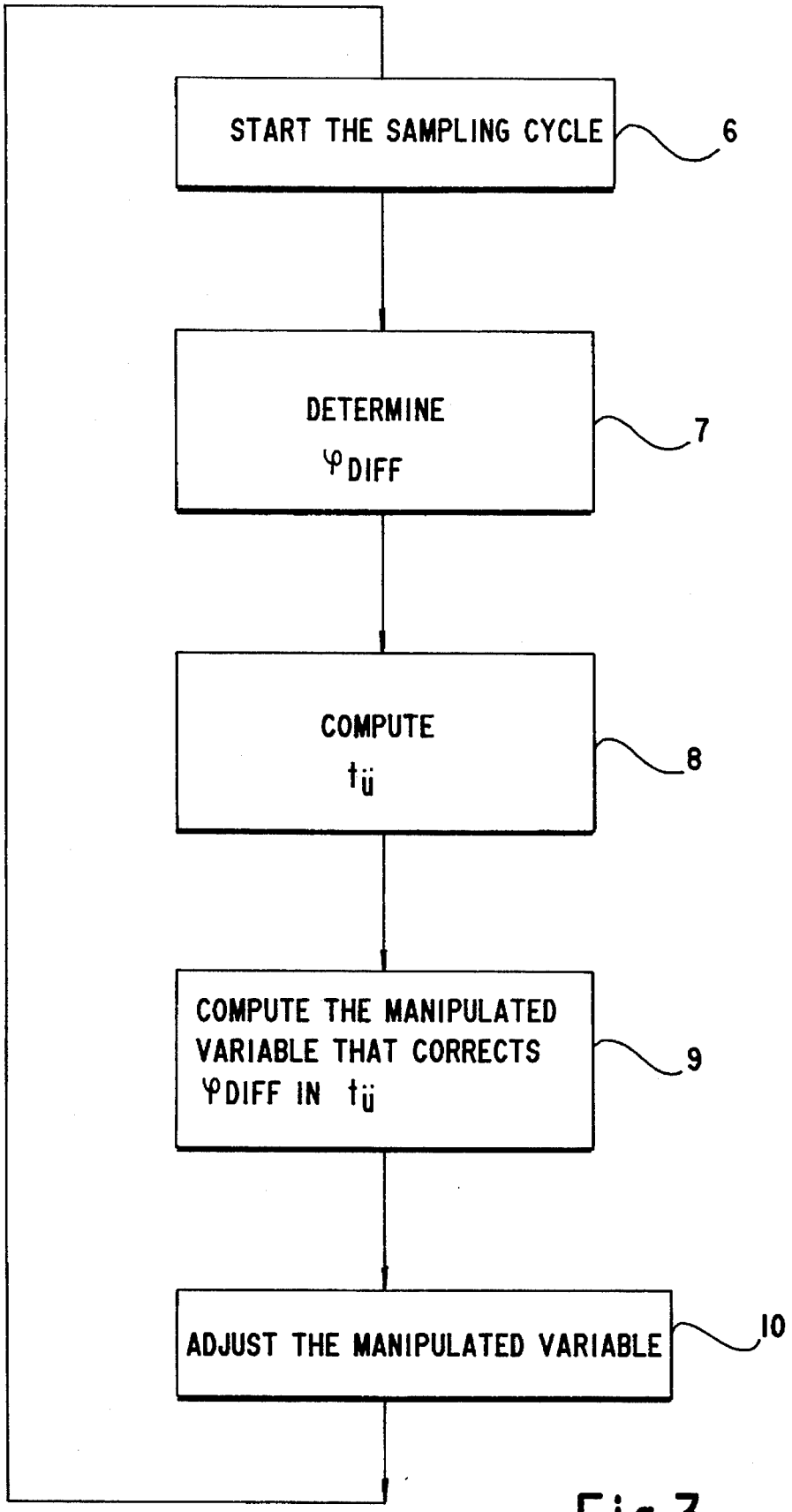
FIG. 3 is a flowchart for the control of the drives in accordance with an embodiment of the drive according to the invention.

FIG. 3 shows a flowchart for the control of the drives 2, 2' in accordance with an embodiment of the drive according to the invention. The algorithm is suitable for the general determination of manipulated variables, i.e. for the determination of the torque M, M' with reference to FIG. 1.

In the following discussion, the determination of manipulated variables according to the invention is always described for one printing unit 1, 1'.

The start of a sampling cycle begins at a point 6. Then, at a point 7, using the rotational-speed setpoint value $n_{setpoint}$ and the angle setpoint value $\phi_{setpoint}$ at which sheet transfer takes place, the angle difference $\phi^*_{diff}$ to sheet transfer is determined. Using the rotational-speed setpoint value $n_{setpoint}$ and the angle difference $\phi_{diff}$, a time $t_{ü}$ to sheet transfer is computed at a point 8. At a point 9 in the flowchart, the manipulated variable M, M' is computed in such a way that the angle difference $\phi_{diff}$ is compensated in the time $t_{ü}$ remaining before sheet transfer. At a point 10, the manipulated variable M, M' is suitably corrected. Following the correction of the manipulated variable M, M', the program starts the next sampling cycle at the point 6.

Figure 4:
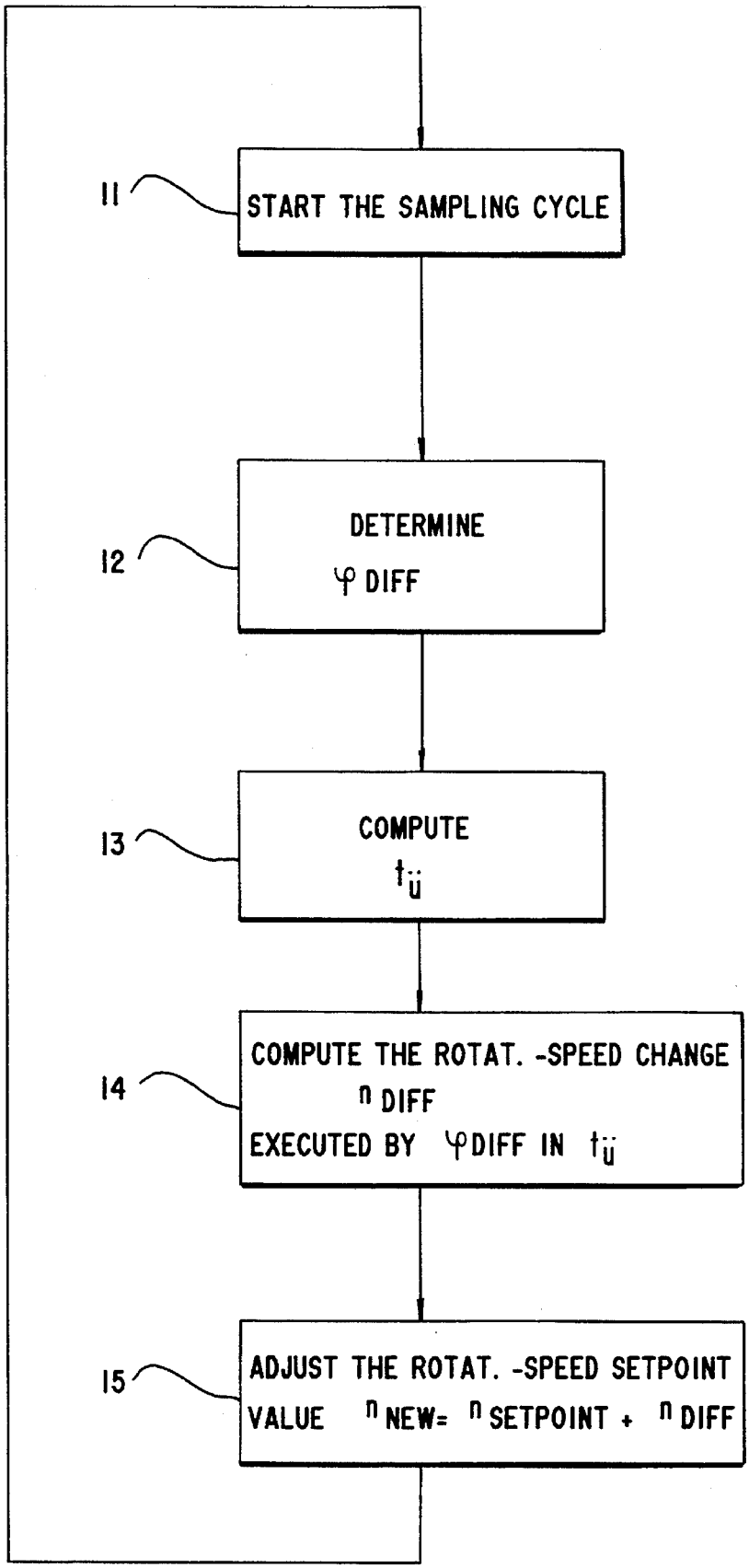
FIG. 4 is a flowchart for the control of the drives in accordance with a further embodiment of the drive according to to the invention.

FIG. 4 shows a flowchart for the control of the drives 2, 2' in accordance with a further embodiment of the drive according to the invention. This flowchart shows an embodiment of the drive according to the invention with secondary rotational-speed regulation or feedback control.

The program starts the sampling cycle at a point 11. At a point 12, as in the previously described embodiment example, the angle difference $\phi_{diff}$ between the angular position $\phi_{actual}$, $\phi'_{actual}$ of the printing units 1, 1' and the preselected angle setpoint value $\phi_{setpoint}$ is determined. Then, at a point 13, the remaining time $t_{ü}$ to sheet transfer is computed from the rotational-speed setpoint value $n_{setpoint}$ and the calculated angle difference $\phi^*_{diff}$. Using the computed time $t_{ü}$, the rotational-speed change $n_{diff}$, is computed at a point 14, wherein the rotational-speed change $n_{diff}$ is dimensioned in such a way that the angle difference $\phi_{diff}$ is compensated precisely in the time $t_{ü}$ remaining before sheet transfer. At a point 15, the computed rotational-speed change $n_{diff}$ is added to the rotational-speed setpoint value $n_{setpoint}$. A new rotational-speed setpoint value $n_{new}$, is used as the basis for the rotational-speed regulation or feedback control of the drives 2, 2'. Then, at the point 11, the program starts the next sampling cycle.

Figure 5:
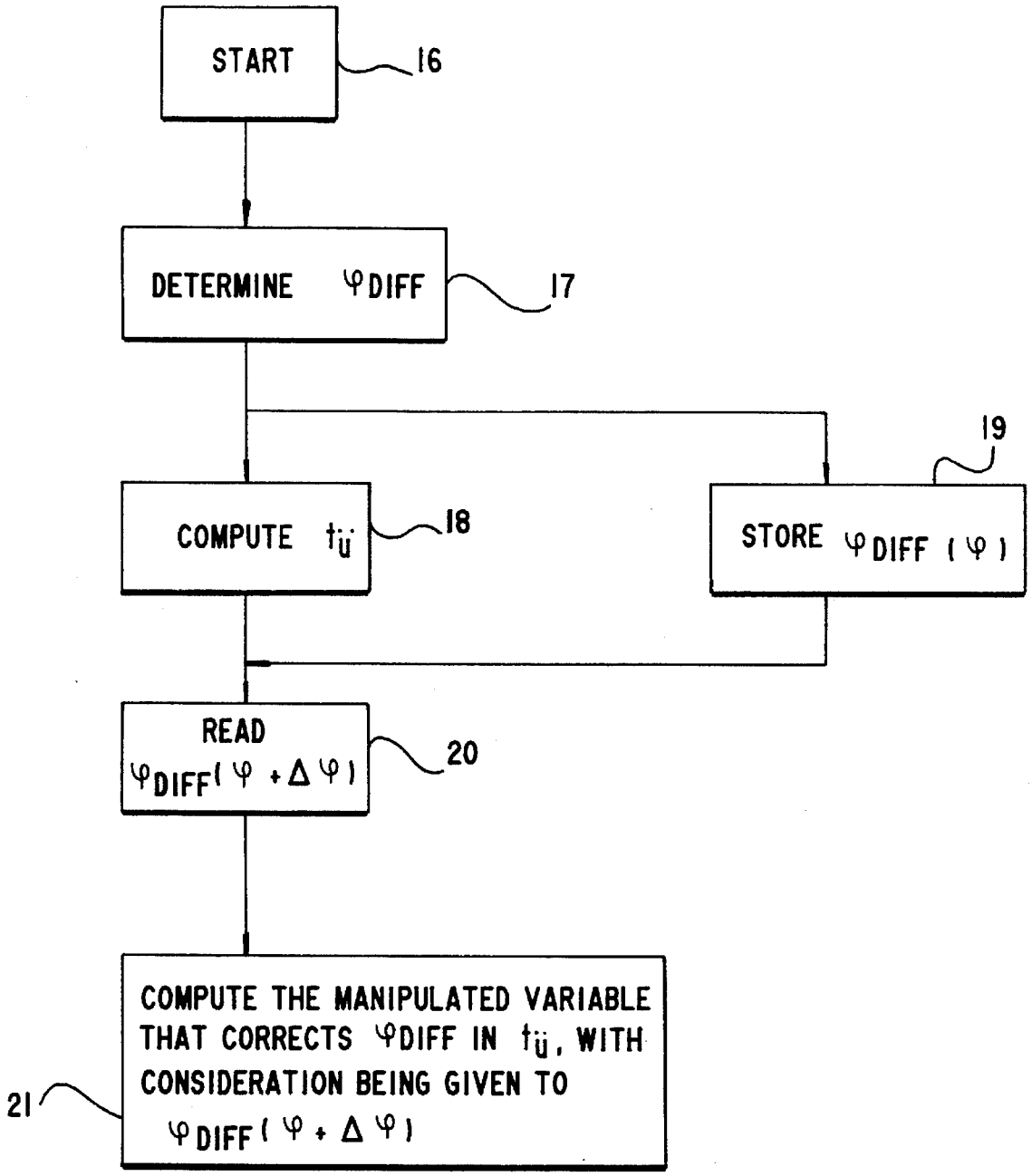
FIG. 5 is a flowchart for the control of the drives in accordance with a further embodiment of the drive according to the invention.

A further advantageous embodiment for the control of the drive according to the invention is shown in FIG. 5. In this embodiment example, use is made of the fact that the torque fluctuations and thus also the angle-of-rotation deviations at the individual printing units 1, 1' occur as a function of the angular position $\phi$ of the printing units 1, 1', if one disregards irregularly occurring, random fluctuations. The regularly occurring fluctuations are repeated cyclically at each revolution of the printing press. It should be noted in this respect that the occurring torque fluctuations and thus also the angle-of-rotation deviations between the individual printing units 1, 1' depend on the press speed v and thus on the rotational speed n of the printing press.

The program starts at a point 16. Then, as in the previously described embodiments, the angle difference $\phi_{diff}$ from the preselected angle setpoint value $\phi_{setpoint}$ is determined. Furthermore, as is likewise described with regard to the preceding examples, at a point 18, the time $t_{ü}$ to sheet transfer is computed from the rotational-speed setpoint value $n_{setpoint}$ and the angle-of-rotation difference $\phi^*_{diff}$ to sheet transfer. The angle-of-rotation difference $\phi_{diff}$ of the printing unit 1 from the preselected angle setpoint value $\phi_{setpoint}$ is stored at a point 19 as a function of the current angle-of-rotation position of the printing unit 1. The previously stored angle difference $\phi_{diff}$ $(\phi+\Delta\phi)$ is read at a point 20. Then, in a part 21 of the program, a manipulated variable M is computed which compensates for the angular deviation $\phi_{diff}$ in the time $t_{ü}$ remaining before sheet transfer, with use being made of the knowledge of $\phi_{diff}$ $(\phi+\Delta\phi)$ from an earlier measurement. In this case, therefore, an additional manipulated variable is computed from the known angle difference $\phi_{diff}(\phi)$ from a previous revolution of the printing press, with the additional manipulated variable taking account of the likely angular deviation. In order to compute the additional manipulated variable, the angle difference $\phi_{diff}$ is stored with the information on the angular position $\phi$ during a revolution of the printing press. A kind of rotational-speed trend is then computed for each stored value. This computation of the additional manipulated variable therefore takes place concurrently with the execution of the control algorithm.

Figure 6:
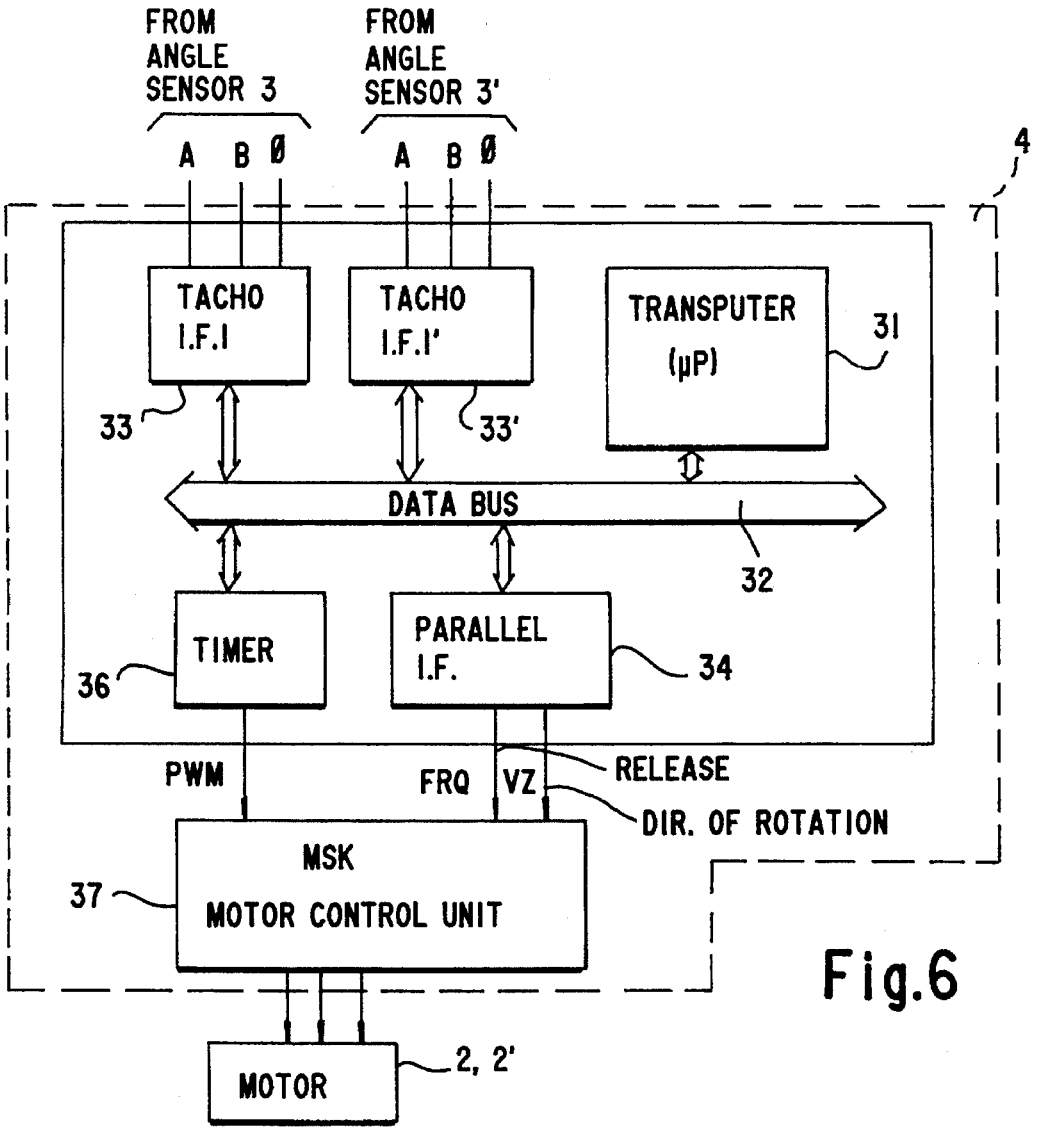
FIG. 6 is a block diagram of the motor control arrangement.
Figure 10:
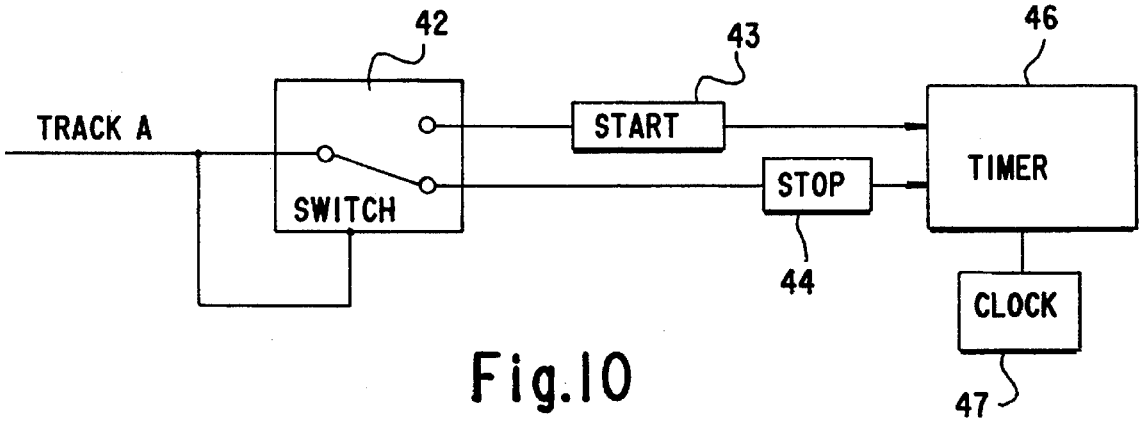
FIG. 10 is a block diagram showing details of the timer circuit and clock circuits.

FIG. 6 shows additional details of the mircoprocessor 4, shown in FIG. 1, wherein a transputer 31 is connected to a data bus 32. The transputer 31 is structured as a conventional microproccesor chip, e.g. of type T805-6255 manufactured by the firm INMOS. The data bus 31 receives respective inputs A, B & 0 from angle sensors 3, 3' in FIG. 1. The angle sensors 3, 3' are advantageously constructed as incremental transmitters typically having three signal tracks A, B, & 0 imprinted therein. Tracks A and B include, e.g. 1024 increment sectors per revolution, mutually phase shifted 90° as shown in FIG. 9. Track 0 generates a single zero pulse for each revolution of the incremental transmitters 3, 3'. Each incremental transmitter is rigidly coupled to a selected rotating component of the respective printing unit 1, 1', such as, for example, the blanket cylinder or the transfer drum which passes each sheet from one printing unit to the next.

The incremental transmitters 3, 3' are manufactured e.g. by the firm Baumer under type designation BDM 05.05A1024/K143.

The angle sensor outputs A, B and 0 are connected to tachometer interface circuits IF1 and IF1', shown with respective reference numerals 33, 33'. Details of the tachometer interfaces are shown in FIG. 8, as described in more detail below. The interfaces 33, 33' communicate via data bus 32 with the transputer 31. The interfaces 33, 33' are typically realized in the form of a micro circuit chip of the type known as an ASIC (Application Specific Integrated Circuit) manufactured by the firm Siemens.

The transputer 32 communicates via data bus 32 with a timer circuit 36 and a parallel interface circuit 34. The timer circuit generates a pulse-width modulated output signal PWM which represents the required current value (or voltage value) to be delivered from the motor control unit 37 to the drive motor 2, 2' for the respective drive units 1, 1' of the printing press. The pulse width of the output signal PWM is modulated in width so that the respective motor 2, 2' drives the printing unit with a respective torque M, M' as required to maintain the printing unit angle $\phi_{act}$ close to or equal to the setpoint value $\phi_{set}$, such that the angle difference $\phi_{act}-\phi_{set}$ falls within the required tolerance.

The parallel interface 34 generates on the basis of signals A, B from the respective angle sensors 3, 3' a direction of rotation signal VZ to the motor 2, 2' on the basis of whether signal A is shifted in phase 90° angle ahead of or trailing signal B, as described in more detail in connection with FIGS. 8 and 9.

The parallel interface 34 also generates a release signal FRG that operates to release certain functions in the motor control unit 37.

FIG. 7 is a control function diagram in conventional LaPlace transform notation of the phase angle controller, showing the steps performed in controlling phase angle 0 of printing unit 1 in angular relation to the phase angle 0' of printing unit 1'. Values n and n' represent the respective rps value of units 1 and 1'. The box $K_B$ represents the amplification factor for the angle controller. Box P(ϕ,tü) represents amplification factor of the angle controller, which is a function of the actual value of the angle deviation ϕ of the sheet-gripper at the point of sheet transfer from one printing unit 1 to the next unit 1'.

The box $K_{PI}$ $(1+T_{PI}S)/S$ represents the rps controller; The box $K_{PR}/(1+T_{PR}S)$ represents the controlled unit, i.e. the controlled printing unit, and box $2\pi/S$ is derived from the number of revolutions n and the angular position ϕ of the printing unit. $T_{P3}$ is the time constant for the rpm controller. $K_{PR}$ is the amplification factor controlling the angle deviation ϕ, and $T_{PR}$ is the time constant controlling the angle deviation ϕ.

FIG. 8 is a block diagram showing the operation of the tacho interface circuit 1, 1' connected with the incremental transmitter, i.e. the angle sensor 3, 3', and FIG. 9 shows the three signals A, B and 0. Signals A and B are two pulse signals from respective tracks on the incremental transmitter 3, 3', which are mutually phase shifted 90°, with track A trailing track B. Signals A and B are connected to respective inputs of an exclusive OR-gate 38, the output of which is connected to a counter 39 of conventional construction, driven by the trailing edge of the output signal from XOR gate 38. The XOR gate operates to double the clock rate of signals A and B.

For each complete rotation the incremental transmitter 3, 3' generates on a separate 0 track, a 0 pulse shown in FIG. 9. The 0 pulse resets, via reset circuit 41, the counter 39 to its 0 position, after which it starts to count again for a next complete rotation of the transmitter. The counter 39 has output leads $D_0$–$D_{15}$, on which output signals represent the state of the counter 39, in either binary or, for example, hexadecimal notation. The count in counter 39 represents the rotational angle of the respective printing unit 1, 1' in relation to the 0 pulse.

Leads D0–D15 are connected via the data bus 32 to the transputer 31, wherein the signals are interpreted as angular position signals for the respective printing units 1, 1', which can then be compared with each other to generate any angular deviations between the printing units 1, 1'. The angular deviations are converted in the transputer 3 by software control, operating as shown in FIG. 7 to generate the signal input required for the timer 36 to generate the pulse-width modulated signal PWM, which in turn steers the motor control unit 37 to control the drive motors 2, 2' so that the phase deviation between the respective printing units 1, 1' will fall within the required tolerances.

We claim:

1. In a printing press including a plurality of mutually mechanically decoupled printing-unit groups, each printing-unit group having at least one individual printing unit, a drive for the printing press, comprising:

sheet transfer means between said printing-unit groups for transferring sheets between the printing unit groups, a plurality of drive motors, each drive motor being coupled with a respective one of the printing-unit groups, a plurality of angle sensing devices, each angle sensing device being coupled with a respective printing-unit group for sensing at least one of rotational-speed and angle-of-rotation of the respective printing-unit group, and an angle computing device having a plurality of inputs, each input being connected to a respective one of said angle sensing devices for computing an angle-of-rotation deviation between the respective printing-unit groups; a setpoint entry device having an output connected to said angle computing device for entering a given angle-of-rotation deviation setpoint value into said computing device, wherein said computing device includes angle of rotation control means connected to said drive, and angle-of-rotation deviation computing means for computing angle-of-rotation deviations between the respective printing unit groups such that the angle-of-rotation deviation at the point of sheet transfer is at a minimum value.

2. The drive according to claim 1, wherein said angle computing device has computing means for computing the angle difference between the setpoint value and the computed angle deviations.

3. The drive according to claim 1, wherein said angle computing device has setting means coupled to said drive motors for setting each printing-unit group to an angle within a range about the angle-of-rotation in which sheet transfer takes place.

4. The drive according to claim 1, wherein said angle computing device has continuously computing means for selecting an angle setpoint value, and means for determining the respective angle-of-rotation deviation of each printing-unit group with respect to the selected angle setpoint value.

5. The drive according to claim 1, wherein said angle computing device has a setpoint entry device for entering an angle setpoint value for the first printing-unit group and for determining the angle-of-rotation deviation of each of the following printing-unit groups with respect to the angle-of-rotation position of a preceding printing-unit group.

6. The drive according to claim 5, wherein said angle computing device has means for determining a time to sheet transfer from a rotational-speed setpoint value $n_{setpoint}$ and the angle setpoint value (M setpoint, M setpoint'), said angle computing device has means for continuously computing a rotational-speed difference $n_{diff}$ by which the rotational–speed setpoint value $n_{setpoint}$ must be adjusted for minimizing the angle-of-rotation deviation in the remaining time to sheet transfer, and said angle computing device has means for controlling a corresponding one of said drive motors according to a calculated new rotational-speed setpoint value $n_{new}=n_{setpoint}+n_{diff}$.

* * * * *